United States Patent [19]

St-Onge

[11] Patent Number: 4,834,685

[45] Date of Patent: May 30, 1989

[54] REVERSIBLE ARMING AND FIRING MECHANISM FOR MARINE MARKERS

[75] Inventor: Michel St-Onge, Neufchâtel, Canada

[73] Assignee: Her Majesty the Queen as represented by the Minister of National Defence of Her Majesty's Canadian Government, Ontario, Canada

[21] Appl. No.: 162,199

[22] Filed: Feb. 29, 1988

[30] Foreign Application Priority Data

Sep. 21, 1987 [CA] Canada ..... 547449

[51] Int. Cl.[4] ..... B63B 22/10

[52] U.S. Cl. ..... 441/8; 441/13; 441/18

[58] Field of Search ..... 441/1, 6, 7, 8, 9, 10, 441/12, 13, 14, 18

[56] References Cited

U.S. PATENT DOCUMENTS

| | | | |
|---|---|---|---|
| 2,791,785 | 5/1957 | Metts | 441/8 |
| 3,035,285 | 5/1962 | Squires | 441/7 |
| 3,329,981 | 7/1967 | Orsino | 441/18 |
| 3,581,352 | 6/1971 | Lavin | 441/8 |
| 3,914,813 | 10/1975 | Berchielli et al. | 441/18 |
| 4,126,907 | 11/1978 | Fish | 441/8 |
| 4,464,129 | 8/1984 | Vancheri et al. | 441/13 |

*Primary Examiner*—Sherman D. Basinger
*Assistant Examiner*—Stephen P. Avila
*Attorney, Agent, or Firm*—Nixon & Vanderhye

[57] ABSTRACT

An improved buoyant pyrotechnic marine marker of the type comprising a water impermeable jacket enclosing a pyrotechnic candle, an ignition device for the candle consisting of a water actuable battery, a candle igniting squib electrically acutated by the battery and circuitry extending between the battery and the squib. The jacket has a gas emission hole for escape of the combustion gases produced by the candle when ignited. The improvement is characterized by a reversible arming mechanism comprising an open ended casing having walls, within which casing is seated a piston with walls slidably cooperating with those of the casing, for axial movement of the piston with respect to the casing. The casing and piston form a chamber adjacent the pyrotechnic candle within which the battery is seated. Guides are provided on confronting overlapping portions of the walls of the casing and piston to permit the piston to slide between an unarmed position and an armed position. An aperture is located in the walls so that it is closed when the piston is in unarmed position and open when the piston is in armed position. The marker is provided with a switch for the circuitry. The switch is mechanically associated with the piston and the casing so that when the piston is in unarmed position the switch is in position keeping the circuitry open and when the piston is moved to armed position, the switch automatically closes the circuitry. The marker according to the present invention provides easier arming and improved safety over conventional markers of this type. It also provides the ability to dearm the marker, if necessary, and to repeat the arming procedure indefinitely as required.

19 Claims, 3 Drawing Sheets

REVERSIBLE ARMING AND FIRING MECHANISM FOR MARINE MARKERS

BACKGROUND OF THE INVENTION

The present invention relates to an improved buoyant pyrotechnic marine marker, deployable from an aircraft, of the type comprising a water impermeable jacket enclosing a pyrotechnic candle, ignition means for the candle consisting of a salt and/or fresh water actuable battery, a candle-igniting squib electrically acutated by the battery and circuitry means extending between the battery and the squib. The jacket has aperture means to be positioned below the water level when the marker is deployed in water to permit water to enter the jacket to actuate the battery. Arming means are mechanically associated with the jacket, and normally close the aperture means but are manipulable to open the aperture means as required. The jacket has a gas emission hole for escape of the combustion gases produced by the candle when ignited.

Such marine markers of conventional construction have presented a number of problems in their usage. These problems are with respect to arming and firing, wastage, ease of use and safety. For example, the arming and firing mechanism for the currently used marker has been thought to result in misfires. The device conventionally has a water activated battery actuated in a chamber, and, in use, air can become trapped in that chamber preventing water from coming in contact with the battery. Additionally, activation of the present water involves two operations: rotation of a cover and opening of two water intake ports to the chamber. Users are often forced to use makeshift tools in order to turn that cover because there is too much friction between the moving parts. Because the activation operations are often difficult to perform, for the sake of efficiency a user will often prepare three, four or five smoke markers in advance for dropping from the aircraft as soon as a locating mission is ordered. In most cases, not all the markers prepared are used. Since the arming mechanisms on them, when armed, are not reversible, it is impossible to turn them back to the safe (unarmed) position. Thus users often throw them into the sea simply to get rid of them.

Another problem with the current marker used is that in the safe, unarmed position, the electrical circuitry which extends between the battery and the firing squib is always closed. There is no switch to open that circuit. This means that, even in the unarmed position, the activating medium (salt and/or fresh water) may accidentally reach the battery and quickly trigger the marker. This is of concern to users since, if they had to make an emergency landing on water and damaged markers were exposed to water, they might become triggered resulting in a major fire and potential fatalities to the crew from the smoke and flame generated by the markers.

Another problem experienced with current marker devices is that they cannot withstand severe temperature and humidity conditions. The chamber within which the battery is contained has poor water tightness. This defect usually does not risk accidently activating the smoke marker since, in these cases, the reaction is so slow that the battery does not provide the power required to ignite the squib. Nevertheless, the slow deterioration thereby caused to the battery may cause such smoke markers to become unreliable or unusable.

It is an object of the present invention to provide an improved buoyant pyrotechnic marine marker which avoids or reduces some of these problems with conventional marker devices.

SUMMARY OF THE INVENTION

In accordance with the present invention there is provided an improved buoyant marine marker of the type comprising a water impermeable jacket and enclosing a pyrotechnic candle, ignition means for the candle consisting of a water actuable battery, a candle-igniting squib electrically acutated by the battery and circuitry means extending between the battery and the squib. The jacket has aperture means to be positioned below the water level when the marker is deployed in water to permit water to enter the jacket to actuate the battery. Arming means are mechanically associated with the jacket, and normally close the aperture means but are manipulable to open and reclose the aperture means as required. The jacket has a gas emission hole for escape of the combustion gases produced by the candle when ignited. The improvement is characterized by the arming means comprising an open ended casing forming part of the jacket and having walls and a piston with walls slidably cooperating with those of the casing, for axial and circumferential movement of the piston with respect to the casing. The casing and piston form a chamber adjacent the pyrotechnic candle within which the battery is seated. Cooperating guide means are provided on facing, overlapping portions of the walls of the casing and piston to permit the piston reversibly to slide, with respect to the casing, between an unarmed position and an armed position. The aperture means is located in the walls so that it is closed when the piston is in unarmed position and open when the piston is in armed position.

In a preferred embodiment of the present invention, the device is further provided with a switch means for the circuitry means. The switch means is mechanically associated with the piston and the casing so that when the piston is in unarmed position the switch means is open and when the piston is moved to armed position, the switch means automatically closes.

The device in accordance with the present invention, as will be described in more detail hereinafter, provides a marker which is significantly easier to use and has improved safety. The arming mechanism on the device is reversible thereby reducing the wastage which can occur with the presently known conventional devices which, once armed, must be used or discarded. The inclusion of a switch means for the circuitry, associated with the arming mechanism, reduces the likelihood of unintended activation of the device.

BRIEF DESCRIPTION OF THE DRAWINGS

These and other objects and advantages of the invention will become apparent upon reading the following detailed description and upon referring to the drawings in which.

Figure 1:
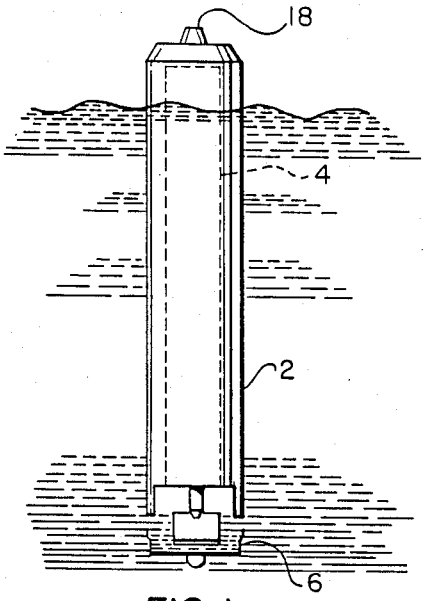
FIG. 1 (PRIOR ART)
FIG. 1 is a side schematic view, in partial section, of a conventional marker.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Figure 2:
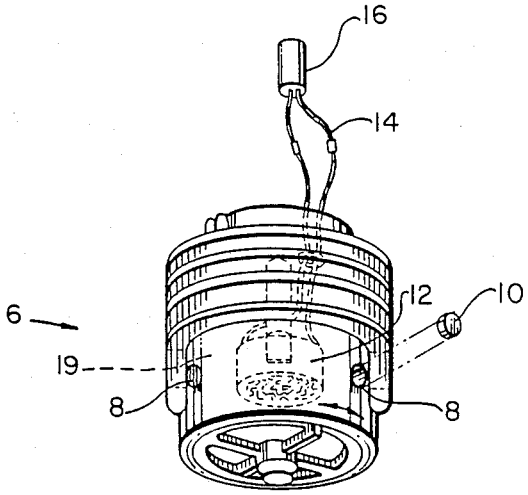
FIG. 2 (PRIOR ART)
FIG. 2 is a perspective view of the arming mechanism of the conventional marker of FIG. 1.

Turning to FIGS. 1 and 2 there is illustrated a conventional buoyant pyrotechnic marine marker of the type in question, having a water impermeable jacket or outer sheath 2 within which is positioned a pyrotechnic candle 4. The ignition means for the pyrotechnic candle is held within a cover 6 which rotates, with respect to jacket 2, from unarmed position in which the removable plugs 10 covering apertures 8 are held locked in place, to armed position in which the removable plugs 10 covering apertures 8 can be pushed in. Removable plugs 10 normally cover apertures 8, and can be removed (i.e. pushed in) when cover 6 is turned to armed position, to expose apertures 8 to the surrounding environment. A water actuable battery 10 is secured within cover 6. Electric circuitry 14 extends between battery 12 to a squib 16 positioned within or adjacent candle 4 so that, when powered by battery 12, squib 16 ignites the contents of candle 4. Candle 4 may conventionally be formed from red phosphorus (and other ingredients) which produces dense white smoke and a yellow flame over a period of time. The combustion gases generated leave jacket 2 through an appropriate aperture 18. One of the problems previously mentioned with such conventional markers lies in the fact that the salt and/or fresh water activated battery, which requires contact with salt water for activation, may be prevented from such exposure to salt water by means of air which becomes trapped in chamber 19 within cover 6, when the marker is floating in salt water as illustrated in FIG. 1 with apertures 8 in cover 6 open.

Turning to the remaining FIGURES, there is illustrated an improved arming mechanism for such a marker device, in accordance with the invention, comprising a casing 21 with a cylindrical wall 22 extending from a closed end to an open end. A piston 24 is provided with a cylindrical wall 26 which flushly fits within wall 22 for slidable axial and rotative movement with respect thereto, wall 26 of piston 24 extending from a closed end 27 to an open end opposite thereto. When walls 22 and 26 overlap, they form between the closed ends of casing 21 and piston 24, a cavity or chamber within which salt and/or fresh water actuable battery 12 is positioned.

Figure 3:
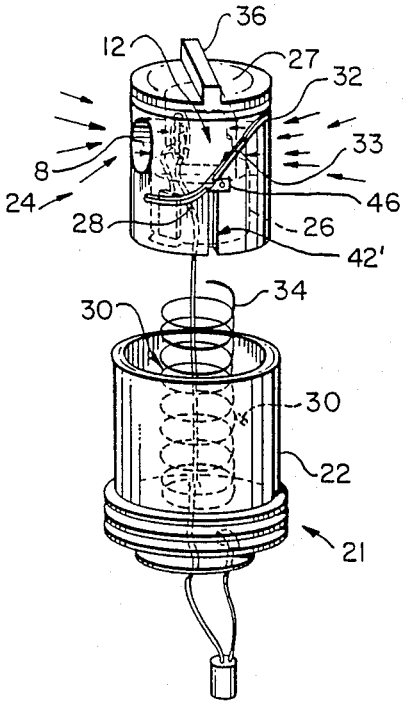
FIG. 3 is an exploded perspective view of the arming mechanism of the improved marker in accordance with the present invention.
Figure 4A:
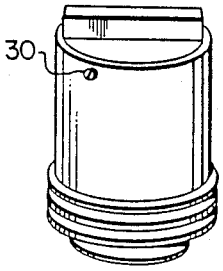
FIGS. 4A and 4B are perspective views of the mechanism of FIG. 3 in, respectively, closed (unarmed) position and open (armed) position.
Figure 4B:
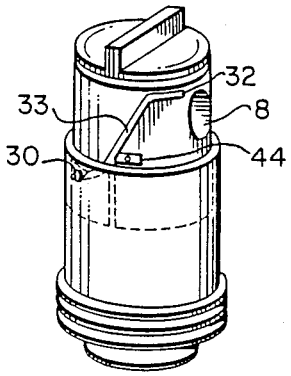

Turning to FIG. 3, a pair of grooves 28, diametrically opposed, on the external surface of wall 26 receive the ends of diametrically opposed pins 30 secured to and projecting outwardly from wall 22. These grooves 28 act as cams with pins 30 sl9iding in them as cam followers to guide piston 24 as it moves between closed (unarmed) position and open (armed) position as illustrated respectively in FIGS. 4A and 4B. A stop, to prevent relative axial movement of piston 24 with respect to casing 21, is provided in the form of circumferentially extending portion 32 to groove 28 (FIG. 3). From this portion 32 of groove 28, the groove continues both axially downwardly and circumferentially in diagonal fashion in FIG. 3, through intermediate portion 33 which permits both rotative and axial relative movement of piston 24 with respect to casing 21 as piston 24 is moved towards its armed position (FIG. 4B). A spring 34 is positioned within the cavity formed by the piston and casing, with its ends bearing respectively against the end wall of the casing and a portion of the piston, to urge piston 24 and casing 21 axially away from each other and hence towards armed position.

As can be seen in FIG. 3, apertures 8 which permit penetration by water to the battery surfaces when the marker device is floating in water, are formed in wall 26 of piston 24. These apertures are sealed closed by an O-ring seal with wall 22 of casing 21 when the mechanism is in closed position (FIG. 4A), but are exposed beyond the upper edges of wall 22 so that water may freely enter the chamber formed by casing 21 and piston 24 when in armed position (FIG. 4B).

A handle 36 secured to the exterior surface of end portion 27 enables the user to easily manipulate piston 24 to move it from unarmed position to armed position. This arrangement of casing 21 and piston 24, in conjunction with pins 30 and grooves 28, readily permits the arming mechanism to be reversible in that the user can repeatedly move piston 24 between armed and unarmed positioned (against the bias of spring 34 when moving to unarmed position).

Figure 5:
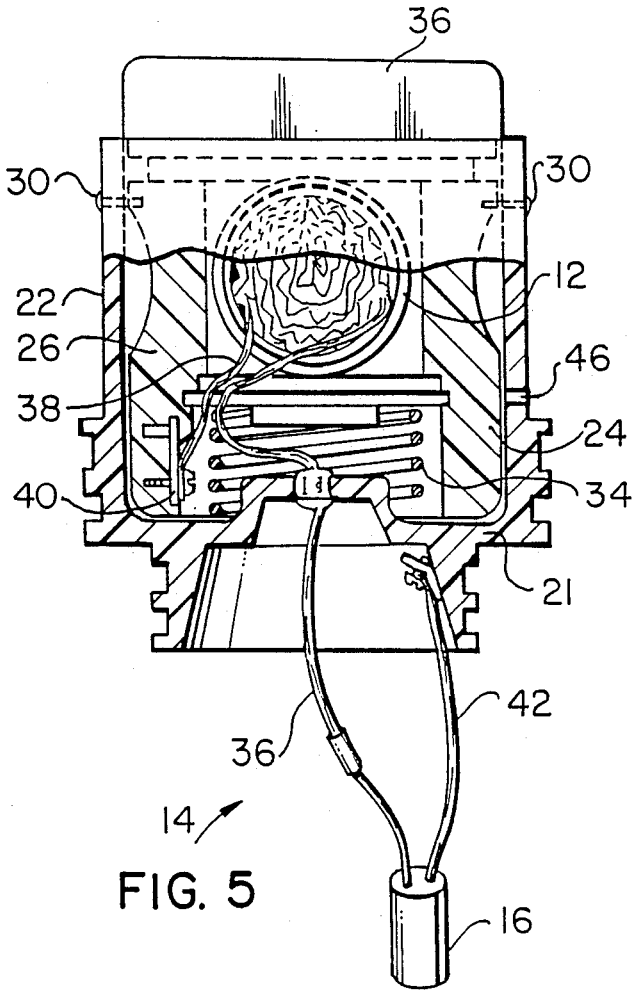
FIG. 5 is a schematic section view, from the side, of the arming mechanism of FIG. 3 in closed (safe) position.

As can be seen in FIGS. 3 and 5, circuitry 14 comprises one lead 36 extending directly between one of the poles of battery 12 and squib 16. The other lead 38 however extends from the other pole of battery 12 to a contact point 40 which is mounted on the inner surface of wall 26, but electrically insulated therefrom. When piston 24 is in armed position, pin 30 makes electrical contact with contact point 40. As can be seen in FIG. 5 since the other lead 42 from squib 16 is secured to and makes electrical contact with a portion of casing 21, and since casing 21 and contact point 40 are made of electrically conductive material, when piston 24 is in armed position with respect to casing 21, and only then, the contacting of contact point 40 by contact pin 30 completes circuitry 14 so that, if battery 12 is in contact with salt or fresh water, squib 16 will be actuated.

The construction of the arming mechanism is such that no air can be trapped around the battery surfaces when the device is in armed position floating in water. This fact, together with the fact that, as illustrated, all the operating surfaces of battery 12 are directly exposed to water when it enters apertures 8, significantly lessens the problem of misfires encountered with previously known marker devices.

In operation, the arming mechanism is attached to the lower portion of a conventional jacket 2 containing a pyrotechnic candle 4 within, so that squib 16 is positioned adjacent the pyrotechnic candle and its actuation will ignite the candle. When the mechanism is in unarmed position (FIG. 4A), contact point 40 and contact pin 30 are disassociated from each other so that circuitry 14 is open while, at the same time, apertures 8 are sealed against the entry of water by means of an "O"-ring positioned in the groove on the surface of piston 24. When it is desired to arm mechanism 20 prior to dropping of the marker for example into the water from an aircraft, the user merely rotates piston 24 (in a counterclockwise direction in the illustrated embodiment) with respect to casing 21 so that pins 30 move into the intermediate portion 33 of grooves 28, thereby freeing piston 24 to rotate and move circumferentially and axially away from casing 21, under urging from spring 34, to move to armed position (FIG. 4B). Then a slight rotation of piston 24 in counterclockwise action provides locking of the piston, and proper contact between pin 30 and contact point 40. In this armed position, pin 30 contacts contact point 40 completing and closing circuitry 14. At the same time because of the relative axial movement of piston 24 away from casing 21, apertures 8 become exposed. Thus, when the marker is dropped into fresh or salt water, with the mechanism forming the bottom of the floating marker, water will flow freely through apertures 8, activate battery 12 and thereby cause squib 16 to ignite candle 4. If, before the marker is deployed into water, the user desires to deactivate it from its activated position, all that is required is to rotate and depress in a clockwise motion, piston 24 with respect to casing 21 until pins 30 ride in circumferential stop portions 32 of grooves 28. Circuitry 14 is thereby opened while apertures 8 are closed. Because circuitry 14 is opened when the device is in unarmed position, even acutation of battery 12 through the unexpected seepage of salt or fresh water will not cause squib 16 to ignite candle 4.

To provide an easy and proper way to assemble or disassemble the piston and casing as it can be seen in FIG. 3, two diametrically opposed grooves 42' communicating respectively with groove 28 are provided on the exterior surface of the wall of piston 24, in which pins 30 can slide to allow assembly or disassembly of parts.

A means such as locking jacket 44 located on piston wall 26 and seated in bracket seal 46 is provided to prevent unintended disassembly of the mechanism during operational use of a marker. This bracket is screwed in place when the piston and casing are assembled.

By unscrewing the locking bracket 44 and through means of the grooves and pins 30, the mechanism can be disassembled as required.

From the foregoing description, many of the advantages of the marker device in accordance with the present invention will be readily understood. Besides lessening the problem of misfires because of the improved positioning of the battery and its direct exposure to water, the marker according to the present invention limits wastage of markers because of the mechanism which may be reversed between armed and unarmed positions repeatedly if the device is not deployed in water. Thus the marker device can easily be replaced quite safely in storage for subsequent reuse even after it has been armed, by turning piston 24 to unarmed position. The marker device in accordance with the present invention thus does not require the user to arm four or five markers in advance as previously was the case, because his preparation now consists simply of a quick turn of the hand to move piston 24 from unarmed to armed position. Additionally, the incorporation of a switch mechanism in the form of contact point 40 and contact pin 30 maintains the electric circuit open when the mechanism is in unarmed position. This switch is also designed for frequent use and the material from which it is made ensures very good electrical conduction when it is in the armed position. Even if a small amount of water should reach the battery when the marker is in unarmed position, as previously discussed, it would not be possible to trigger the marker because, in this position, circuitry 14 is open. The mechanism of the present invention shows improved resistance to environmental conditions such as temperature and humidity. This device is designed to be operated manually without forcing and without requiring makeshift tools as was the case with conventional markers.

The present invention is also provided with a simple, quick and efficient assembling or disassembling feature to ensure the manufacturers and users a safe procedure of assembling and disassembling the marker firing mechanisms.

Thus it is apparent that there has been provided in accordance with the invention an improved arming mechanism for buoyant marine markers that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. In a buoyant pyrotechnic marine marker comprising a water impermeable jacket and enclosing a pyrotechnic candle, ignition means for the candle consisting of a water-actuable battery, a candle-igniting squib electrically actuated by the battery and circuitry means extending between the battery and the squib, the jacket having aperture means to be positioned below the water level when the marker is deployed in water to permit water to enter the jacket to actuate the battery, and arming means mechanically associated with the jacket to normally close the aperture means but manipulable to pen the aperture means as required, the jacket having a gas emission hole for escape of combustion gases produced by the candle when ignited, the improvement comprising the arming means comprising an open ended casing forming part of the jacket and having walls and a piston with walls slidably cooperating with the walls of the casing, for axial and circumferential movement of the piston with respect to the casing, the casing and piston forming a chamber adjacent the pyrotechnic candle within which the battery is seated, cooperating guide means on facing, overlapping portions of the walls of the casing and piston for permitting the piston reversibly to slide, with respect to the casing, between an unarmed position and an armed position, said guide means comprising a cam means on one of the facing surfaces of the walls of the casing and the piston and a cooperating cam follower on the other, said aperture means being located in the walls of the piston so that said aperture means is closed when the piston is in unarmed position and open when the piston is in armed position.

2. A marker according to claim 1 wherein the cam means are two diametrically opposite grooves in one of the confronting surfaces and the cam follower is two diametrically opposite projections from the other facing surface extending into the grooves to slide therein.

3. A marker according to claim 2 wherein the walls are cylindrical and wherein the groove and projection are arranged so as to permit rotation of the piston with respect to the casing to move the piston from unarmed to armed position.

4. A marker according to claim 1 or 3 wherein handle means are provided on the piston to permit its rotation with respect to the casing.

5. A marker according to claim 2 wherein the grooves and projections are arranged so as to permit axial movement of the piston with respect to the casing so that, as the piston moves axially from unarmed position to armed position the aperture means is opened.

6. A marker according to claim 5 wherein a biasing means is provided in the cavity to urge the piston axially away from the casing and facilitate its movement from unarmed to armed position.

7. A marker according to claim 6 wherein the biasing means comprises a spring means.

8. A marker according to claim 3 wherein the groove and projection are arranged so as also to permit axial movement of the piston with respect to the casing so that, as the piston moves axially from unarmed position to armed position the aperture means is opened and wherein a biasing means is provided in the cavity to urge the piston away from the casing and facilitate its movement from unarmed to armed position.

9. A marker according to claim 8 wherein the groove is provided with a stop means to prevent unintended movement of the piston from unarmed to armed position.

10. A marker according to claim 9 wherein a portion of the groove is circumferentially positioned with respect to the walls when the groove and projection are in unarmed position so as to provide the stop means, and wherein an adjacent portion of the groove is positioned to permit simultaneous relative axial and rotative movement of the piston with respect to the casing as the piston moves from unarmed to armed position.

11. A marker according to claim 1 further provided with a switch means for the circuitry means, the switch means being mechanically associated with the piston and the casing so that when the piston is in unarmed position the switch means is open and when the piston is moved to armed position, the switch means automatically closes.

12. A marker according to claim 5 further provided with a switch means for the circuitry means, the switch means being mechanically associated with the piston and the casing so that when the piston is in unarmed position the switch means is open and when the piston is moved to armed position, the switch means automatically closes.

13. A marker according to claim 8 further provided with a switch means for the circuitry means, the switch means being mechanically associated with the piston and the casing so that when the piston is in unarmed position the switch means is open and when the piston is moved to armed position, the switch means automatically closes.

14. A marker according to claim 11, 12 or 13 wherein the switch means comprises a first contact means associated with the piston and a second contact means associated with the casing, the first and second contact means engaging to close the circuitry means when the piston is in armed position and the first and second contact means being disengaged so the circuitry means is open when the piston and casing are in unarmed position.

15. A marker according to claim 1 wherein the guide means comprises two grooves diametrically opposed on the external surface of the piston wall in which pins mounted on the casing wall slide axially, and a locking means is secured to the external surfaces of the piston wall to secure the casing and piston together and prevent unintended disassembly thereof.

16. In a buoyant pyrotechnic marine marker comprising a water impermeable jacket enclosing a pyrotechnic candle, ignition means for the candle consisting of a water-actuable batter, a candle-igniting squib electrically actuated by the battery and circuitry means extending between the battery and the squib, the jacket having aperture means to be positioned below the water level when the marker is deployed in water to permit water to enter the jacket to actuate the battery, an arming means mechanically associated with the jacket to normally close the aperture means but manipulable to open the aperture means as required, the jacket having a gas emission hole for escape of combustion gases produced by the candle when ignited, the improvement comprising the arming means comprising an open ended casing forming part of the jacket, and having cylindrical walls and a piston with cylindrical walls slidably cooperating with the walls of the casing, for axial movement of the piston with respect to the casing, the casing and the piston forming a chamber adjacent the pyrotechnic candle within which the battery is seated, cooperating guide means on facing overlapping portions of the walls of the casing and piston for permitting the piston reversibly to slide, with respect to the casing, between an unarmed position and an armed position, said guide means comprising two grooves on one of the facing surfaces of the walls cooperating with two projections from the other facing surface extending into the grooves, to slide therein, sid grooves and projections being arranged so as to permit rotation of the piston with respect to the casing to move the piston from unarmed to armed position, said aperture means being located in the walls of the piston so that it is closed when the piston is in unarmed position and open when the piston is in armed position, and wherein a switch means for said circuitry means is provided, said switch means being mechanically associated with the piston and the casing so that when the piston is in unarmed position the switch means is opened and when the piston is moved to armed position, the switch means automatically closes.

17. A marker according to claim 16 wherein the grooves and projections are arranged so as also to permit axial movement of the piston with respect to the casing so that, as the piston moves axially from unarmed position to armed position the aperture means is opened.

18. A marker according to claim 17 wherein a biasing means is provided in the cavity to urge the piston axially away from the casing and facilitate its movement from unarmed to armed position.

19. A marker according to claim 18 wherein the switch means comprises a first contact means associated with the piston and a second contact means associated with the casing, the first and second contact means engaging to close the circuitry means when the piston is in armed position and the first and second contact means being disengaged so the circuitry means is open when the piston and casing are in unarmed position.

* * * * *